United States Patent [19]

Koike et al.

[11] Patent Number: 4,633,752

[45] Date of Patent: Jan. 6, 1987

[54] OPERATING PANEL DEVICE IN ELECTRONIC MUSICAL INSTRUMENT

[75] Inventors: Tatsuhiro Koike, Hamakita; Takamichi Masubuchi, Hamamatsu, both of Japan

[73] Assignee: Nippon Gakki Seizo Kabushiki Kaisha, Hamamatsu, Japan

[21] Appl. No.: 658,152

[22] Filed: Oct. 5, 1984

[30] Foreign Application Priority Data

Oct. 8, 1983 [JP] Japan ..... 58-156273

[51] Int. Cl.[4] ..... G10H 1/06

[52] U.S. Cl. ..... 84/1.03; 84/1.19; 84/DIG. 12

[58] Field of Search ..... 84/477 R, 478, 480, 84/479 R, 1.03, DIG. 12, 1.19

[56] References Cited

U.S. PATENT DOCUMENTS

| | | | |
|---|---|---|---|
| 2,517,026 | 8/1950 | Quednau | 84/478 |
| 3,185,016 | 5/1965 | Stinson | 84/480 |
| 4,538,495 | 9/1985 | Sato | 84/477 R |

*Primary Examiner*—Arthur T. Grimley
*Assistant Examiner*—David Warren
*Attorney, Agent, or Firm*—Spensley Horn Jubas & Lubitz

[57] ABSTRACT

In an operating panel device for an electronic musical instrument, in order to provide easy mode-changeover operation and to enable the user to easily catch the relationship between respective operating knobs and the functions selected by the operating knobs in respective modes, the operating panel device comprises a plurality of operating members arranged in a row on the panel; a display window provided near and along the row of these operating members; an elongated indicating member rotatably supported on the rear side of the panel and having a plurality of indicating sections on which the names of functions of the musical instrument and/or the names of tonal characteristics settable for respective operating knobs in respective set modes are inscribed on its circumference so as to selectively appear on the display window; a plurality of LEDs arranged in a row to correspond to the operating knobs respectively. The user selects one of the setting modes by rotating the indicating member, and the operating knobs perform functions then shown on the indicating section in the display window.

11 Claims, 8 Drawing Figures

FIG. 3

| | | | | | | | | | | | | | | | | |
|---|---|---|---|---|---|---|---|---|---|---|---|---|---|---|---|---|
| (a) | MELODY (UK) | ORGAN | PICCOLO | TRUMPET | VIOLIN | SAXO-PHONE | OBOE | PIANO | MUSICBOX | HARPSI-CHORD | GUITAR | SYNTHE 1 | SYNTHE 2 |
| (b) | CHORD (LK) | ORGAN | PICCOLO | TRUMPET | VIOLIN | SAXO-PHONE | OBOE | PIANO | MUSICBOX | HARPSI-CHORD | GUITAR | SYNTHE 1 | SYNTHE 2 |
| (c) | BASS (PK) | ORGAN | PICCOLO | TRUMPET | VIOLIN | SAXO-PHONE | OBOE | PIANO | MUSICBOX | HARPSI-CHORD | GUITAR | SYNTHE 1 | SYNTHE 2 |
| | -------- | | | | | | -------- | | | | | | |
| (j) | RHYTHM | MARCH | WALTZ | BALLAD | SWING | SLOW ROCK | 8 BEAT | TANGO | LATIN | BOSSA-NOVA | SAMBA | DISCO | 16 BEAT |

OPERATING PANEL DEVICE IN ELECTRONIC MUSICAL INSTRUMENT

BACKGROUND OF THE INVENTION (a) Field of the Invention

The present invention relates to an improvement in operating panel device in an electronic musical instrument.

(b) Description of the Prior Art

On the panel face of a keyboard electronic musical instrument in general, there are provided a number of operating knobs or buttons which are, for example, switches and volumes for setting the functions of the musical instrument such as automatic rhythm and autobass chord (called "ABC" briefly) and for setting tonal characteristics such as tone color, tone volume and effect separately for each keyboard or key range. Such operating knobs number about fifty (50) at least, and can amount to as many as two hundred (200) in a large-scale instrument. These many operating or manipulating knobs are disposed on the panel face in a plurality of groups, each group consisting of knobs belonging to a similar functional category. Because the knobs are provided not a few in number, the user of the instrument, especially the beginners, tends to consume much time to operate the knobs and gets confused.

With the aim to reduce the number of these manipulating knobs which are provided on the panel face, a proposal has been made to provide a group of operating knobs in common for several different modes (for example, Japanese Utility Model Preliminary Publication No. Sho 57-57496). In this prior art, however, a plurality of mode-changing switches are disposed on the panel face. Therefore, as the number of modes increases, the number of the mode-changing switches which are to be provided on the panel face naturally increases accordingly, and this, in turn, gives rise to the inconvenience that the easy operability of the instrument is hampered. In addition, the user of this instrument encounters a difficulty and becomes confused in catching the relationship between the respective knobs and the working functions for the respective modes which are to be selected by manipulating these knobs.

SUMMARY OF THE INVENTION

It is, therefore, the primary object of the present invention to provide a new operating device for the panel of a keyboard electronic musical instrument (which, hereinafter to be called briefly "operating panel device"), which eliminates such inconveniences as mentioned above.

In the operating panel device for an electronic musical instrument according to the present invention, there are provided, on the face of the panel, a row of a plurality of operating knobs such as switches and volumes, and also at least one display window in the vicinity of the row of knobs along the direction in which these operating knobs are provided. Also, on the rear side of the panel, in the vicinity of the display window, there is provided a movable member which is comprised of, for example, a rotatable polygonal column having a plurality of indicating sections on the polygonal faces corresponding respectively to a plurality of modes such as upper keyboard tone color setting mode and rhythm selecting mode. These indication sections carry the names of those functions of musical instruments or the names of those tonal characteristics which can be set for each operating knob for a selected setting mode, in such a way that these names can appear on the display window. In addition, on the rear side of the panel, there are provided a mode designating means, a mode detecting means and a setting enabling means. The mode designating means is intended to designate the plurality of modes one after another by driving a movable member so as to bring the plurality of indication sections to apper in the display window one after another. The mode detecting means is arranged so that it detects the designated setting mode and delivers out a detection signal. The setting enabling means enables, in accordance with the detection signal received, the setting of the function of a musical instrument or the setting of the tonal characteristic in a designated certain setting mode by the manipulation of a plurality of operating knobs of the panel face.

According to the present invention, arrangement is provided so that, by utilizing a movable member having a plurality of indication sections corresponding to various modes, the user can designate and display the name of a settable function of a musical instrument, the name of the tonal characteristic and so on for each mode by manipulating the group of operating knobs on the panel face. Thus, this group of panel operating knobs can be utilized in common for a plurality of modes, whereby the number of the operating knobs on the panel can be reduced substantially. Also, according to the present invention, there is no need to provide mode-changing switches in such a large number as in the prior art on the panel face. Accordingly, the arrangement of the operating knobs on the panel face is simplified, resulting in the advantage that an easily operable electronic musical instrument is realized.

This and other objects of the present invention will become more apparent during the course of the following detailed description and appended calims.

BRIEF DESCRIPTION OF THE DRAWINGS

FIG. 3 is an illustration showing an example of inscriptions carried on the rotatable indicating member.

DETAILED DESCRIPTION OF THE PREFERRED EMBODIMENTS

Figure 1:
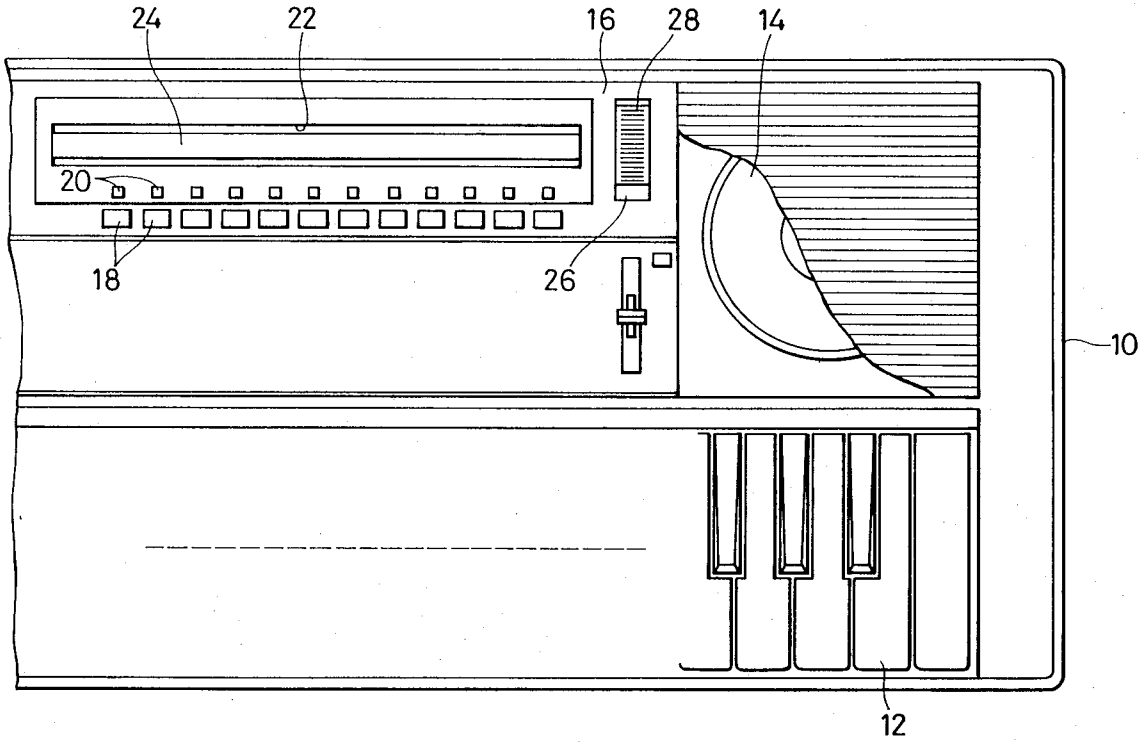
FIG. 1 is a diagrammatic plan view, showing an embodiment of the operating panel device for an electronic musical instrument according to the present invention.

In FIG. 1, reference numeral 10 represents the body of a keyboard electronic musical instrument; 12 a keyboard; 14 a loud speaker; and 16 a panel. In this embodiment, there is shown the keyboard of a single stage, but it should be understood that a lower keyboard and a foot pedal keyboard may be provided in addition thereto.

On the face of the panel 16, twelve operating knobs 18 forming a group and each consisting of a self-return type depression button switch are arranged side by side in one row. In the vicinity of these operating knobs 18, twelve indicator elements 20 forming a group and each consisting of an LED (light-emitting diode) are arranged side by side in one row so as to correspond in location to the operating knobs 18, respectively. Also, in the vicinity of the group of operating knobs 18, there is provided an elongated display window 22 along the direction in which the operating knobs are arranged. In the vicinity of this display window 22 on the rear side of the panel 16, there is provided a rotatable indicating member 24 having a polygonal columnar configuration. Furthermore, in the vicinity of the extreme right end (in FIG. 2) of the display window 22, there is provided a through-hole 26 of a rectanglar shape. Also, in this through-hole 26 on the rear side of the panel 16, there is provided a rotatable manipulator 28 protruding beyond the panel face to serve as a mode disignating means. This rotatable manipulator 28 is intended to drive the rotatable indicating member 24 to rotate.

Figure 2:
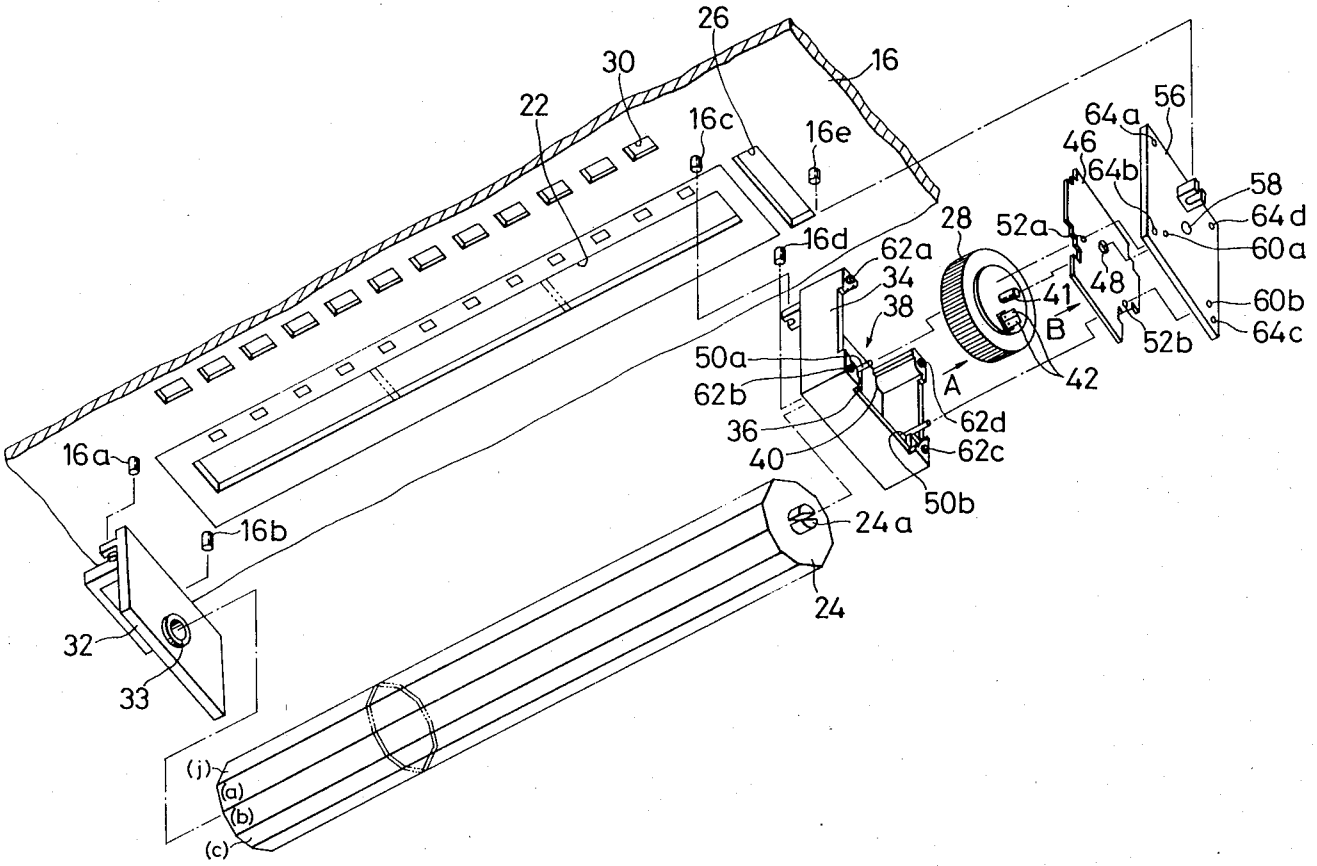
FIG. 2 is a diagrammatic exploded perspective view of the mode designating section and display section of the device of FIG. 1.

In FIG. 2, reference numeral 30 represents holes formed through the panel 16 to serve for the arrangement of the operating knobs 18 therethrough. On the rear side of the panel 16, there are provided projections 16*a*~16*e* for screw-anchoring the panel 16. A pair of supporting walls 32 and 34 are provided to rotatably support the rotatable indicating member 24. The supporting wall 32 is arranged to be screw-anchored to the projections 16*a* and 16*b*, while the supporting wall 34 is arranged to be screw-anchored to the projections 16*c* and 16*d*. The rotatable indicating member 24 is comprised of, for example, a decagonal column having ten (10) sides or faces (a)~(j). This columnar member 24 has, at its both ends, a pair of split projections serving as a shaft for rotation of the member 24. One of these two pairs of projections is inserted into a hole 33 of the supporitng wall 32, and the other is inserted into a hole 36 of the other supporting wall 34, respectively, to thereby rotatably support the columnar member 24. The faces (a)~(j) of the rotatable indicating member 24 constitute ten (10) indicating sections corresponding, respectively, to the ten (10) setting modes. These indicating sections carry settable items as shown in, for example, FIG. 3.

In FIG. 3 symbols (a)~(j) manifest those items which are inscribed on the facial sections (a)~(j), respectively, of the rotatable indicating member 24. For example, the face (a) carries the inscriptions of twelve (12) names of tone colors such as organ, piccolo and trumpet corresponding in number to the operating knobs 18, for given melody tones played on the upper keyboard UK. In a similar way, the face (b) can carry the names of tone colors for chords played on the lower keyboard LK. The face (c), on the other hand, can carry the names of tone colors for bass tones played on the pedal keyboard PK. Though not shown, the face (d) can carry the inscriptions of envelope setting mode, while the face (h) the inscriptions of effect setting mode, and the face (i) the inscriptions of automatic accompaniment setting mode. And, the face (j) carries the inscriptions of twelve (12) names of rhythm such as march, waltz and ballad corresponding in number to the operating knobs, to enable the selection of rhythms in an automatic rhythm playing. It should be noted here that there is no need to inscribe twelve (12) setting items for each indication face of the rotatable member 24, and that there may be blank sections appropriately on the indication face. In such an instance, the operating knob corresponding to a blank section of the face is naturally an inoperative one.

The supporting wall 34 has a recessed space 38 formed on that side not facing the end face of the rotatable indicating member 24. A rotatable manipulator 28 is provided in this recessed space 38. The pair of shaft-serving projections 24*a* provided on the right end (as viewed in FIG. 2) of the rotatable indicating member 24 in the state of being rotatably supported on the supporting wall 34, is fit and fixed in a recess formed on that side of the rotatable manipulator 28 indicated by the arrow A. As this rotatable manipulator 28 is rotated, the rotatable indicating member 24 is rotated accordingly. To insure that, during the course of revolution of the rotatable indicating member 24, its faces (a)~(j) each can be unfailingly stopped temporarily at the position in which it is viewed through the display window 22, there is provided an anchoring projection 40 on the bottom face of the recessed space 38 of the supporting wall 34, and concurrently therewith ten (10) notches are provided at equal intervals on a same circumference of that face of the rotatable manipulator 28 indicated by the arrow A so as to be brought into successive engagement with the anchoring projection 40. This arrangement constitutes a click means. Also, on that side of the rotaatble manipulator 28 opposite to the side indicated by the arrow A, there are provided a shaft-serving projection 41 and a pair of brushes 42 serving as movable contacts.

Figure 4:
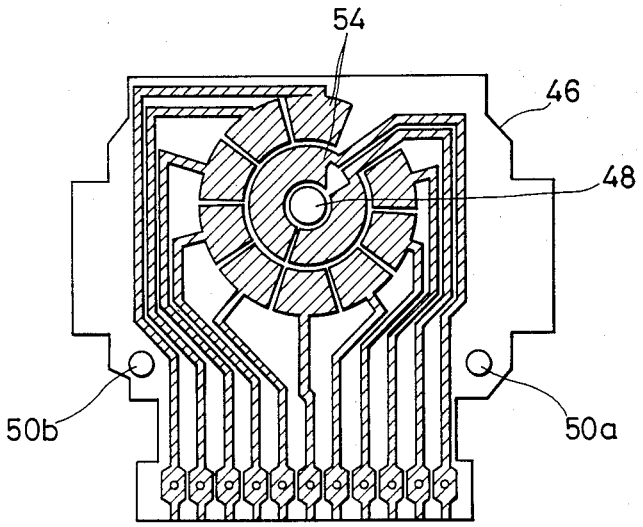
FIG. 4 is a diagrammatic plan view showing a pattern of fixed contacts.

As insulating plate 46 has a hole 48 for the insertion of the projection 41 of the rotatable manipulator 28, and holes 52*a* and 52*b* for the insertion of a pair of bolts 50*a* and 50*b*, respectively, of the supporting wall 34. The face indicated by the arrow A of the rotatable manipulator 28 has the formation of a fixed contact pattern 54 as shown in FIG. 4 to constitute a rotation position detecting switch together with the brushes 42. The rotation position detecting switch thus constructed is operative to render nine (9) pairs of fixed contacts conductive successively one after another for each pair by the brushes 42 in accordance with the revolution of the rotatable manipulator 28. This rotation position detecting switch is arranged to be operative so that, by applying to any given setting mode, the state in which the brushes 42 are not in contact with any one of the fixed contacts, there can be detected ten (10) rotation positions corresponding, respectively, to the ten (10) setting modes which are designated by the rotatable manipulator 28.

A cover plate 56 has a hole 58 for the insertion of the projection 41 of the rotatable manipulator 28, holes 60*a* and 60*b* for the insertion of the bolts 50*a* and 50*b* of the supporting wall 34, respectively, and screw-anchoring holes 64*a*~64*d* corresponding to screw-anchoring holes 62*a*~62*d* of the supporting wall 34.

After the rotatable manipulator 28 and the insulating plate 46 have been mounted onto the supporting wall 34, the cover plate 56 is placed thereonto so as to cover them, and is fixed to the supporting wall 34 by means of the bolts 50*a* and 50*b* via a pair of nuts, and concurrently the plate is screw-anchored onto the supporting wall 34 by screws not shown which are screwed into the holes 62*a*~62*d* after passing through the holes 64*a*~64*d*. When the supporting wall 34 is screw-anchored onto the projections 16*c* and 16*d* of the panel 16, the cover plate 56 is screw-anchored onto the projection 16*e* of the panel 16.

According to the mode designation section and display section having the above-described construction, it is possible to designate ten (10) setting modes one after another in clicks by operating the rotatable manipulator 28, and to concurrently indicate the designated mode on the display window 22. Also, from the rotation position detecting switch which is comprised of the combination of the rotatable manipulator 28 and the insulating plate 46, there can be derived a detection signal representing the designated and displayed setting mode.

Figure 5:
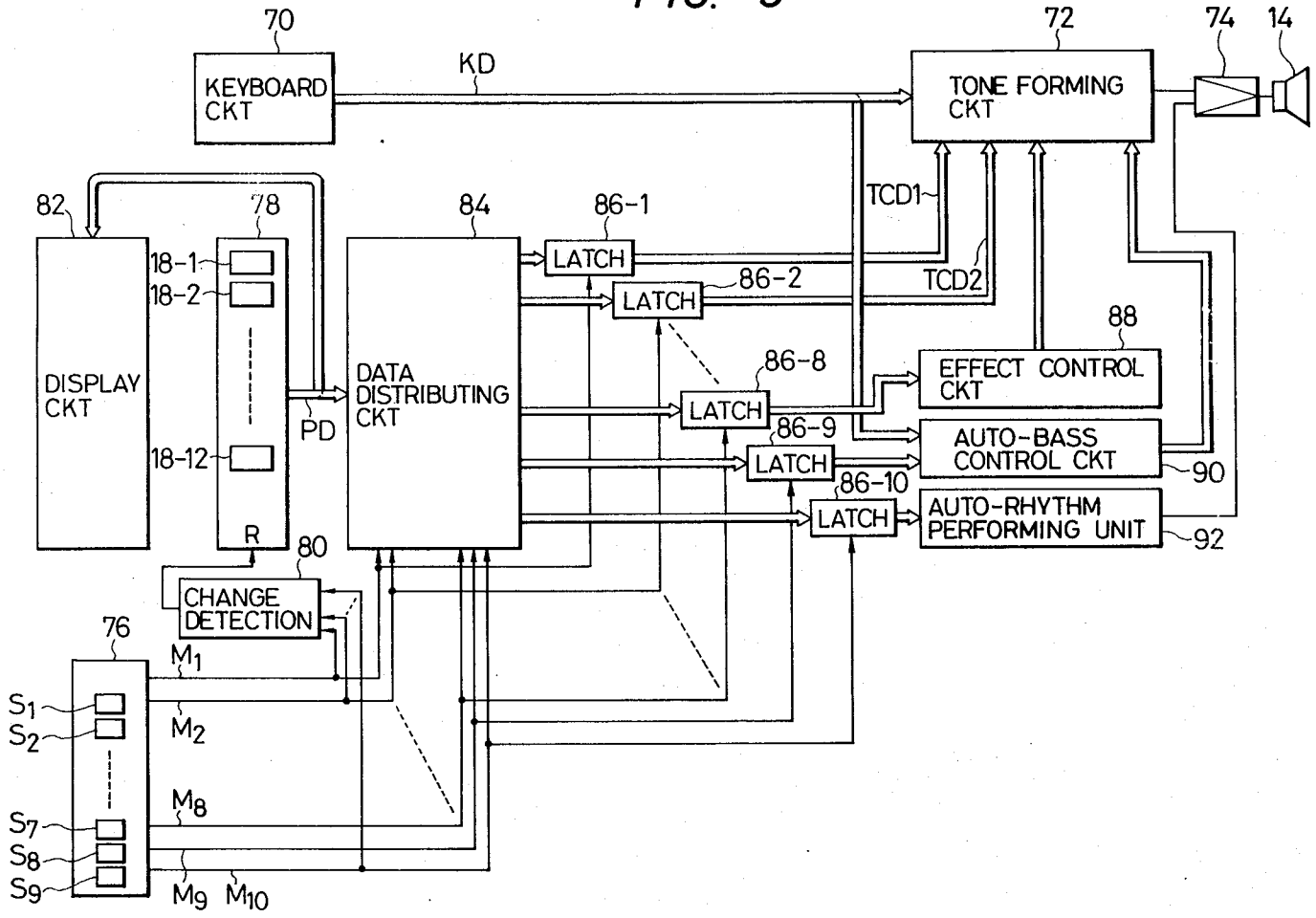
FIG. 5 is a block diagram showing an example of the circuit arrangement of the keyboard electronic musical instrument according to the present invention.

Next, by referring to FIG. 5, description will be made of the circuit arrangement and the operating of the electronic musical instrument shown in FIG. 1.

A keyboard circuit 70 contains the abovesaid keyboard 12 and so forth. This circuit is arranged so that it delivers, to a tone forming circuit 72, key depression data KD indicative of the key which is depressed on the keyboard.

The tone forming circuit 72 forms a tone signal based on the key depression data KD. As the tone signal which is delivered out therefrom includes not only a melody tone signal corresponding to the key operation of the keyboard, but also a chord tone signal corresponding to the operation of keys on the lower keyboard if such is provided, as well as automatic accompaniment tone signal such as auto-chord and auto-bass, and further, in case a foot pedal keyboard is provided, a bass tone signal corresponding to a pedal key operation. The tone signals delivered from the tone forming circuit 72 are supplied, via an output amplifier 74, to the loudspeaker 14 to be converted to a sound.

A mode detecting circuit 76 includes nine (9) switch elements $S_1 \sim S_9$ of the abovesaid rotation position detecting switch, and is arranged so as to deliver out mode detection signals $M_1 \sim M_{10}$ corresponding to the ten (10) rotation positions, respectively. When the upper keyboard tone color setting mode is designated by causing the face (a) of the rotatable indicating member 24 to appear in the display window 22, the circuit 76 detects that the switch elements $S_1 \sim S_9$ are invariably in their "off" state, and generates a mode detection signal $M_1$. In accordance with the successive turning-on of the switch elements $S_1, S_2, \ldots S_9$ as the rotatable manipulator 28 rotates progressively, it is possible to generate mode detection signals $M_2, M_3, \ldots M_{10}$ successively.

An operating knob circuit 78 includes the abovesaid twelve (12) operating knobs 18 (18-1~18-12) and twelve (12) flip-flop circuits which are triggered in accordance with the turning-on operations of these operating knobs 18, respectively. The respective flip-flop circuits are arranged to be reset when a power supply switch is turned on and also when a change detecting circuit 80 has detected the generation of either one of the mode detection signals $M_1 \sim M_{10}$.

The operating knob circuit 78 supplies, to a display circuit 82 and to a data distribution circuit 84, an operation data PD indicative of the operating state of the operating knobs 18-1~18-12. The display circuit 82 includes the abovesaid twelve (12) indication devices 20, and is arranged so that it controls the lighting up of these indication elements 20 in accordance with the operation data PD received. Also, the data distribution circuit 84 distributes and supplies the operation data PD to either one of latch circuits 86-1~86-10 in accordance with the mode detection signals $M_1 \sim M_{10}$. These respective latch circuits are arranged so that the operation data PD is latched, i.e. registered, in synchronism with the pulse-down timing of a corresponding mode detection signal from "1" to "0".

Let us here assume that, when the power supply switch is turned on, the face (a) of the rotatable indicating member 24 is noted on the display window 22. Whereupon, the mode detecting circuit 76 generates a mode detection signal $M_1$ corresponding to the upper keyboard tone color setting mode. A desired melody tone color can be set by enabling either one of the operating knobs 18-1~18-12 on the panel face. Let us assume that, in order to select the tone color of organ mentioned in column (a) of FIG. 3, the user turns on the operating knob switch 18-1 of FIG. 5 (which is the knob located at the extreme left in FIG. 1). Whereupon, the indicating element (LED) 20 located at the extreme left in FIG. 1 and corresponding to this operating knob 18-1 is lighted up.

Next, the rotatable manipulator 28 is operated to manifest the face (b) of the rotatable indicating member 24 on the display window 22. Whereupon, the mode detecting circuit 76 generates a mode detection signal $M_2$ corresponding to the lower keyboard tone color setting mode. Accordingly, a desired chord tone color can be set by turning on either one of the operating knob switches 18-1~18-12 provided on the panel face. In this instance, immediately before the flip-flop circuit within the operating knob circuit 78 is reset in accordance with the mode detection signal $M_2$, operation data for setting the upper keyboard tone color is latched in the latch circuit 86-1. This latch data is supplied, as upper keyboard tone color controlling data $TCD_1$, to the tone forming circuit 72.

After setting a chord tone color in this way, the face (c) of the rotatable indicating member 24 is caused to appear on the display window 22. Whereupon, operation data for setting a lower keyboard tone color is latched in the latch circuit 86-2. This latched data is supplied, as a lower keyboard tone color controlling data $TCD_2$, to the tone forming circuit 72. Also, the setting of a bass tone color becomes possible by operating either one of the operating knobs 18-1~18-12 on the panel face. Thereafter, it is possible to perform a similar setting operation for each setting mode.

In a similar manner, based on the setting operation concerning an effect such as vibrato effect and tremolo effect, an effect controlling data is supplied from the latch circuit 86-8 to an effect controlling circuit 88. This effect controlling circuit 88 controls one or plural effect circuits within the tone forming circuit 72 in accordance with the effect controlling data.

Based on the setting operation concerning an automatic accompaniment such as auto-chord and auto-bass, automatic accompaniment controlling data is supplied from the latch circuit 86-9 to an automatic accompaniment controlling circuit 90. The automatic accompaniment controlling circuit 90 controls the operation of the automatic accompaniment section within the tone forming circuit 72 in accordance with key depression data from a lower key range section or a lower keyboard and with automatic accompaniment controlling data.

Based on the operation of selecting one type of rhythms from among various kinds rhythm as shown in the column (j) of FIG. 3, rhythm type designation data is supplied from the latch circuit 86-10 to an automatic rhythm performance device 92. This automatic rhythm performance device 92 generates a rhythm tone signal concerning a specific type of rhythm (which, for example, is waltz) designated by the rhythm type designation data. This rhythm tone signal is supplied to the loudspeaker 14 via the output amplifier 74 to be converted to a sound.

Figure 6:
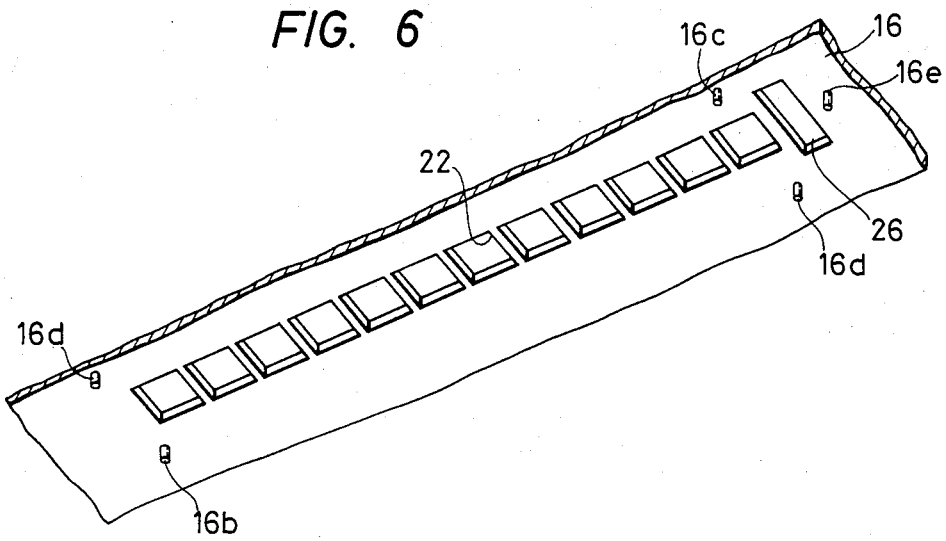
FIG. 6 is a diagrammatic perspective view showing another example of the display window section different from that in FIG. 2.
Figure 7:
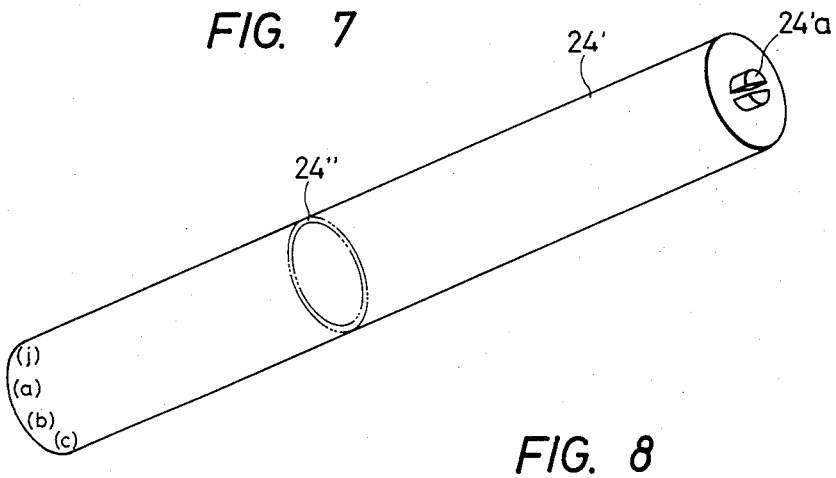
FIG. 7 is a diagrammatic perspective view showing another example of rotatable indicating member different from that shown in FIG. 2.

In the above-stated embodiment, switches have been shown as an example of the operating knobs. The operating knobs, however, may be comprised of volumes. Also, only one display window has been provided in common for all the operating knobs. It should be understood, however, that there may be provided a plurality of windows in a number corresponding to the operating knobs so as to correspond to them respectively, as shown in FIG. 6. Alternatively, there may be provided a plurality of independent windows an shown by dot-and-chain lines in FIG. 2 in a number corresponding to the number of the groups into which a plurality of operating knobs is divided. Furthermore, the rotatable indicating member may be a polygonal cylinder as shown by dot-and-chain lines in FIG. 2, or it may be a circular column 24' as shown in solid line in FIG. 7 or may be a round tube 24'' as shown by dot-and-chain lines in FIG. 7. Moreover, the display of a settable item on the display window by the movable member is not limited to what is shown which utilizes the rotatable indicating member, but it may be performed by rotating, for example, a belt or chain carrying a plurality of indication sections thereon, or by moving up and down or sideways a plate provided with a plurality of indication sections. Furthermore, the driving of the movable indicating member is not limited to that done by manipulation, but also it may be driven by an electric motor.

Figure 8:
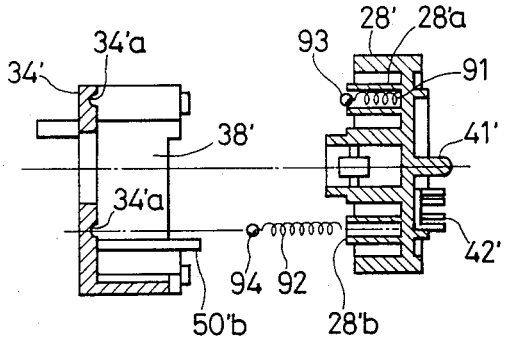
FIG. 8 is a diagrammatic partial sectional view, showing another example of the portion including the rotatable manipulator, which is different from what is shown in FIG. 2.

FIG. 8 shows an example of the click construction, different from what is shown in FIG. 2, for positively halting a face (a)~(j) of the rotatable indicating member 24 temporarily in the display window 22, which construction being established between a supporting wall 34' and a rotatable manipulator 28'. That is, in this example, the rotatable manipulator 28' is provided, on that side facing the supporting wall 34', with a pair of axially extending tublar formation **28'*a* and 28'*b* at positions of a same radius of the manipulator 28'. Coil springs 91 and 92 each having a length somewhat great than the length of the tubes 28'*a* and 28'*b* in the non-compressed state of the springs are inserted in these tubes, respectively. On the bottom face of the recessed space 38' of the supporting wall 34' facing the coil springs 91 and 92, there are formed a required number of semi-spherical recesses 34'*a* at uniform intervals on a same circle. When the rotatable manipulator 28' is assembled onto the supporting wall 34', there are placed steel balls 93 and 94 to intervene between the resulting compressed coil springs 91 and 92 and their facing recesses 34'*a*** to thereby establish a click means.

What is claimed is:

1. An operating panel device in an electronic musical instrument, comprising:

a panel having a plurality of operating members arranged at least in one row and a display window formed in the vicinity of said row of operating members and extending the length of said row of operating members;

an indicating member rotatably provided in the vicinity of said display window of said panel and having on its circumference a plurality of indicating sections corresponding to a plurality of modes, each of said sections being comprised of a plurality of segments which correspond to said row of operating members and which contain the names of functions of said musical instrument and/or names of tonal characteristics which may be set by said operating members, whereby said indicating member causes an indicating section associated with a selected setting mode to appear in said display window;

mode designating means coupled to said indicating member to cause one of said plurality of indicating sections to appear in said display window which is associated with a selected one of said plurality of modes;

mode detecting means associated with said mode designating means to detect a mode designated by said mode designating means and to deliver out a mode selection signal; and means electrically connected to said mode detecting means to enable the setting of the function of the musical instrument and/or the tonal characteristic in accordance with the operation of selected operating members corresponding to the desired function name and/or tonal characteristic.

2. An operating panel device according to claim 1, in which:

said display window is formed as a single window of a rectangular configuration.

3. An operating panel device according to claim 1, in which:

said display window is comprised of a plurality of independent window sections.

4. An operating panel device according to claim 1, in which:

said indicating member has a polygonal columnar external configuration having sides corresponding in number to said indicating sections.

5. An operating panel device according to claim 1, in which:

said indicating member is formed as a tube or a cylinder.

6. An operating panel device according to claim 1, wherein said plurality of segments are arranged in the vicinity of said row of a plurality of operating members to correspond to said members, respectively, for indicating the state of operation of said members.

7. An operating panel device according to claim 1, in which:

said operating members and said names of functions of the musical instrument and/or tonal characteristics which are to be set by said operating members are arranged to have positional correspondence with each other.

8. An operating panel device according to claim 1, in which:

said mode designating means comprises a manipulator for driving said indicating member to rotate, and said mode detecting means detects a position to which said manipulator has been rotated.

9. An operating panel device according to claim 8, in which:

said position to which said manipulator has been rotated is designated by click means associated with said manipulator.

10. An operating panel device according to claim 1, in which:

said means for enabling the setting of the functions of the musical instrument and/or the tonal characteristics comprises a plurality of registering means allotted to said respective modes to store informations concerning the operating state of said operating members in respective allotted modes.

11. An operating panel device for an electronic musical instrument, comprising:

a display window for displaying a plurality of elements relating to the musical characteristics of the tone to be produced by said electronic musical instrument;

a row of selecting means for selecting a desired element from among said elements displayed in said display window;

a rotatable member positioned in proximity to said display window and having said elements arranged in horizontal rows extending along the length of said member such that one row of said elements at a time is visible through said display window;

mode detecting means for detecting a selected mode based on the rotational position of said member; and means for altering the musical characteristics of the tone produced by said electronic musical instrument based on the detected mode and the operation of said selecting means.

* * * * *